United States Patent [19]

Morooka et al.

[11] 4,030,326

[45] June 21, 1977

[54] GAGE CONTROL APPARATUS AND METHOD FOR TANDEM ROLLING MILLS

[75] Inventors: Yasuo Morooka; Shinya Tanifuji, both of Hitachi, Japan

[73] Assignee: Hitachi, Ltd., Japan

[22] Filed: Aug. 20, 1976

[21] Appl. No.: 716,281

[30] Foreign Application Priority Data

Aug. 25, 1975 Japan ..... 50-102163

[52] U.S. Cl. ..... 72/8; 72/11; 72/16

[51] Int. Cl.[2] ..... B21B 37/00

[58] Field of Search ..... 72/8, 9, 10, 11, 12, 72/16, 19

[56] References Cited

UNITED STATES PATENTS

| | | | |
|---|---|---|---|
| 3,677,045 | 7/1972 | Arimura et al. | 72/8 |
| 3,782,153 | 1/1974 | Winchester | 72/9 |
| R25,075 | 10/1961 | Hessenberg | 72/9 |

*Primary Examiner*—Milton S. Mehr
*Attorney, Agent, or Firm*—Craig & Antonelli

[57] ABSTRACT

Gage control apparatus and methods for tandem rolling mills are disclosed which are based on the low of constancy of mass flow. The apparatus and methods are attained by the discovery of the fact that the forward slip ratio of a mill stand varies as a linear function of the reduction ratio particularly when a plate material is rolled under relatively low tension. A ratio between thicknesses of the plate at the output and input sides of a particular stand of the tandem rolling mill and a ratio between circumferential speeds of rolls of the adjacent stands are used to calculate a thickness of the plate at the ouput or input side of each of the stands other than the particular stand. Each of the stands other than the particular stand is adjusted in its roll gap in accordance with a deviation of the calculated thickness from a desired thickness so as to cancel the deviation.

15 Claims, 6 Drawing Figures

GAGE CONTROL APPARATUS AND METHOD FOR TANDEM ROLLING MILLS

BACKGROUND OF THE INVENTION

1. Field of the Invention

The present invention relates to gage control apparatus and methods for tandem rolling mills and in particular to an automatic gage control apparatus and methods based on the low of constancy of mass flow.

2. Description of the Prior Art

As one of gage control apparatus for the rolling mills, there has been hitherto well known a gage control system of rolling load feedback type, which is disclosed in U.S. Pat. No. 2,680,978 to Raymond Bernard Sims and widely employed in many practical applications. According to the principle of such type gage control system, a rolling load or pressure P and a screw-down position or a roll gap S are detected and the thickness of a plate material to be rolled at the output side of a mill stand (output thickness) is estimated in accordance with the following formula (Hooke's law):

$$h = S + P/M \qquad (1).$$

where

*h:* estimated output thickness,

M: rigidity coefficient of mill stand. When the estimated thickness is deviated from a desired thickness to be accomplished, the screw-down position or the roll gap S is adjusted so that the deviation becomes zero. This method is simple in control. However, it is known that an offset in gage will disadvantageously occur due to errors in the detected null or zero point of the screw-down position or the like factors. With an attempt to cancel out such an offset, it is common to dispose a gage meter at the output side of each mill stand and correct the screw-down position as a function of the offset quantity by feeding back the detected value from the gage meter. Besides, in the case of the control system of the rolling load or pressure feedback type described above, a detection of the rolling pressure P is necessary and thus involves indispensably such difficulties as described below.

Assuming that there exists a roll eccentricity, the roll gap, i.e. the gap between the rolls will be varied as the rolls are rotated even when the screwdown position which is set with reference to the axes of the rolls is constant. Such situation will prevail also during the rolling operation and the variation in the roll gap will appear as a variation in the rolling load or pressure as measured usually by a load cell. It will be known that the rolling load will increase, when the actual roll gap is reduced as the rolls are rotated. On the other hand, when the roll gap is increased during the rotation of the rolls, the rolling load is decreased. Since measurement of the roll gap S in the equation (1) during the rolling operation will encounter with a great difficulty in practice, the following method is usually adopted. Namely, a position at which the upper and lower rolls are snugly fitted without any material squeezed therebetween is taken as the zero point of the screw-down position and the roll gap S is estimated on the basis of the difference between the zero point and the set screw-down position. Accordingly, the roll gap S of the equation (1) will constitute a constant at the step at which the screw-down position has been set before the pass of the late material to be rolled. The rolling load is increased when the actual roll gap is being decreased due to the eccentricity of the rolls, and the estimated thickness *h* as derived from the formula (1) will be increased. The control system would operate to adjust the screw-down position and rotation speeds of the rolls so that the deviation of the estimated thickness from a desired thickness to be attained may become zero. Therefore, notwithstanding the fact that the thickness of the rolled material at the output side of the mill stand is really decreased, the control would be effected so as to more reduce the thickness of the rolled material by enforcively lowering the screw-down position in response to the increase in the rolling load. On the contrary, when the roll gap is increasing due to the eccentricity of the rolls, the control is carried out in such a manner that the thickness of the rolled material will be undesirably increased.

As will be appreciated from the above description, the rolling load feedback type control system responds to the influence of the roll eccentricity in the reversed sense. For the similar reason, the above control system responds to the variation in the radius of the rolls such as caused by thermal expansion of the roll diameter in the reversed sense, i.e. the control system operates to exaggerate the adverse influence of the roll eccentricity rather than compensate it.

To do away with the above problems, it is conceivable to dispose the thickness measuring devices i.e. gage meters at both the input and the output sides of each of the mill stands and to effect the control operation with the aid of the detected values from these devices. However, such an arrangement of the rolling mill will necessarily involve high expensiveness in addition to difficulty that the arrangement can not be applied to the existing plants since no extra spaces are available for installing the gage meters.

Under these circumstances, a gage control method based on the law of constancy of mass flow has been developed. However, the hitherto known control systems utilizing such principle are not always satisfactory in respect of the attainable accuracy because of insufficient analysis of the actual rolling phenomenon.

SUMMARY OF THE INVENTION

Accordingly, an object of the present invention is to provide gage control apparatus and methods for tandem type rolling mills which eliminate the drawbacks described above.

Another object of the invention is to provide inexpensive gage control apparatus which are operative with an improved stability and enhanced accuracy.

The invention utilizes the law of constancy of mass flow which is well known per se. However, the invention is made on the basis of the discovery that the forward slip ratio included in the mathematical expression of the low of constancy of mass flow is not a constant but a variable proportionately depending upon the reduction ratio. In other words, in view of the fact that the reduction ratio is a linear function of the ratio between the thicknesses of a rolled plate at the input and the output sides of a mill stand, this ratio is utilized in the gage control system according to the invention. For this end, the input thickness and the output thickness of a plate to be rolled at a particular mill stand of a tandem rolling mill are measured thereby to determine the reduction ratio. Further, the circumferential speeds of rolls at every mill stand are detected to determine the ratio of the circumferential speeds at the adjacent mill stands. The output and the input thicknesses at the other mill stands than the particular stand are arithmetically calculated from the above thickness ratio and circumferential speed ratios. The results thus obtained are employed to effect the gage control by adjusting the screw-down position or the like factor of the individual mill stands. As the particular stand described above, the first or the last mill stand may be used.

The above and other objects, features and advantages of the invention will become more apparent from the detailed description of preferred embodiments of the invention taken in conjunction with the accompanying drawings.

DETAILED DESCRIPTION OF THE PREFERRED EMBODIMENTS

Before entering into detailed description of embodiments of the invention, the principle of detecting the output thickness and the input thickness, i.e. thicknesses of a plate at the output and the input sides of each mill stand of a tandem rolling mill, will be first described.

It is assumed that the rolling operation is performed at the i-th mill stand and (i+1)th mill stand of a tandem rolling mill. Under this condition, the following relation will validly be obtained, which is well known in the art as the low of constancy of mass flow:

$$h_i \cdot V_{Ri} \cdot (1 + f_i) = h_{i+1} \cdot V_{Ri+1} \cdot (1 + f_{i+1}) \quad (2)$$

where $i$, $i+1$ are identifications of the mill stands, $h_i$ designates output thickness of a plate at the $i$-th stand (mm), $V_{Ri}$ circumferential speed of the roll of the $i$-th stand (mm/sec), $f_i$ forward slip ratio at the $i$-th stand, $h_{i+1}$ output thickness of the plate at the $(i+1)$th stand (mm), $V_{Ri+1}$ circumferential speed of the roll of the $(i+1)$th stand (mm/sec), and $f_{i+1}$ forward slip ratio at the $(i+1)$th stand.

In the above equation (2), it is common to use experimentally determined values for the forward slip ratios $f_i$ and $f_{i+1}$. Accordingly, the forward slip ratios are usually handled as constants during the rolling operation.

Figure 1:
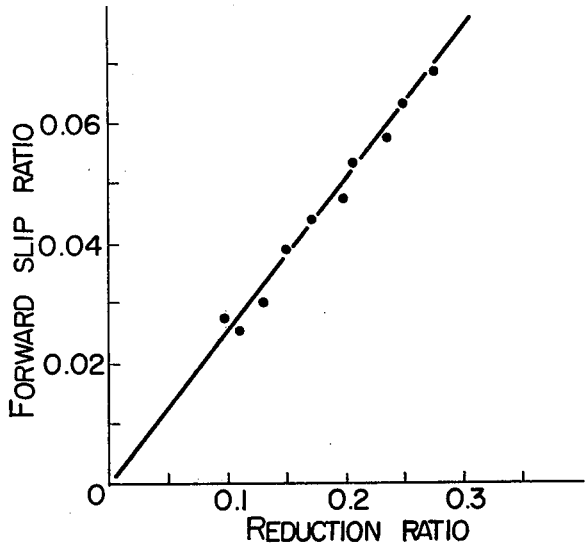
FIG. 1 shows graphically a relation between the reduction ratio and the forward slip ratio which underlies the invention.

The inventors, however, have found after analysis of operation data obtained in a hot rolling mill of tandem type that the forward slip ratio is not a constant but a variable and exhibit a significant correlation with the reduction ratio as shown in FIG. 1. In other words, it has been ascertained that the following equation is obtained approximately to the relation between the forward slip ratio $f_i$ and the reduction ratio $r_i$:

$$f_i = a \cdot r_i \quad (3)$$

wherein $a$ is a constant which has been about 0.25 in the case of the rolling mill employed in the analysis. The equation (3) applies most approximately to the hot rolling in which a relatively low tension prevails. In the case of cold rolling where a high tension prevails, the addition of a constant C to the equation (3) is necessary for the relation between $f_i$ and $r_i$, that is, $f_i = a \cdot r_i + C$ applies preferably to the case of cold rolling. The reduction ratio $r_i$ of the $i$-th stand is defined as follows:

$$r_i = 1 - h_i/H_i \quad (4)$$

where $H_i$ designates input thickness of a plate, and $h_i$ output thickness of the plate.

From the equations (2), (3) and (4), the following is obtained.

$$\frac{V_{Ri}}{V_{Ri+1}}\left(1 + a - a\frac{h_i}{H_i}\right) = \frac{h_{i+1}}{H_{i+1}}\left(1 + a - a\frac{h_{i+1}}{H_{i+1}}\right) \quad (5)$$

When the equation (5) is rewriten with $h_i/H_i = X_i$ and $h_{i+1}/H_{i+1} = X_{i+1}$, then $$X_i = 1 + \frac{1}{a} - \frac{V_{Ri+1}}{V_{Ri}} \cdot X_{i+1}\left(1 + \frac{1}{a} - X_{i+1}\right) \quad (6)$$

$$X_{i+1} = \frac{1}{2}\left[1 + \frac{1}{a} - \sqrt{\left(1 + \frac{1}{a}\right)^2 - 4\frac{V_{Ri}}{V_{Ri+1}}\left(1 + \frac{1}{a} - X_i\right)}\right] \quad (7)$$

where $X_i > 0$ and $X_{i+1} > 0$

From the equations (6) and (7), it can be seen that the input and the output thicknesses at the individual stands of the tandem rolling mill can be determined by detecting the input and the output thickness at an arbitrarily selected stand.

By way of an concrete example, the input thickness $H_F$ and the output thickness $h_F$ at the last stand F are detected. From $H_F$ and $h_F$, the thickness ratio $X_F$ can be determined as $X_F = h_F/H_F$. When $X_F$ has been thus determined, the thickness ratio $X_{F-1}$ at the stand F-1 immediately preceding the last stand F can be calculated by using the equation (6), where $X_i$ is replaced by $X_{F-1}$ and $X_{1+1}$ is replaced by $X_F$ which has been determined. When $X_{F-1}$ has been thus determined, the thickness ratio $X_{F-2}$ at the last third stand F-2 preceding the stand F-1 can be also calculated from the equation (6) with $X_i$ and $X_{i+1}$ replaced by $X_{F-2}$ and $X_{F-1}$, respectively. In this manner, the thickness ratio $X_i$ can be obtained on the basis of the equation (6) sequentially in the upstream direction. When the thickness ratio $X_i$ has been determined, the input thickness $H_i$ at the $i$-th stand which is the output thickness at the $(i-1)$th stand can be determined from the following relation:

$$H_i = h_{i+1} = h_i X_i \quad (8)$$

For example, the output thickness $h_{F-2}$ at the stand F-2 is equal to $h_{F-1}/X_{F-1}$.

It is assumed that plate thickness detecting means are disposed at the output and the input sides of the first stand to measure the input thickness $H_1$ and the output thickness $h_1$. In this case, the thickness ratio $X_i$ can be determined from $X_i = h_i/H_i$. Then, the thickness ratio $X_2$ at the second stand can be obtained from the equation (7). After obtaining the value of the ratio $X_2$, the same calculation is repeated for obtaining the thickness ratio $X_3$ at the third stand. In this manner, it is possible to determine the thickness ratios at the individual stands with the aid of the equation (7) sequentially in the downstream direction. When the thickness ratios $X_i$ have been determined for the individual stands, the output thickness at the $i$-th stand which is the same as the input thickness at the $(i+1)$th stand can be given by the following expression $$h_i = h_{i-1} \cdot X_i \qquad (9)$$

For example, for the second stand, the output thickness $h_2$ can be given by $h_2 = h_1 \cdot X_2$.

The present invention contemplates to detect the input and the output thicknesses at a particular mill stand and the circumferential speeds of rolls at the individual stands, thereby to calculate the thickness ratios at the individual stands in accordance with the equation (6) or (7) and then calculate the thickness of a rolled plate. The gage control is effected in accordance with the calculated thickness.

For better understanding of the invention, now a description will be made on several embodiments of the invention.

Figure 2:
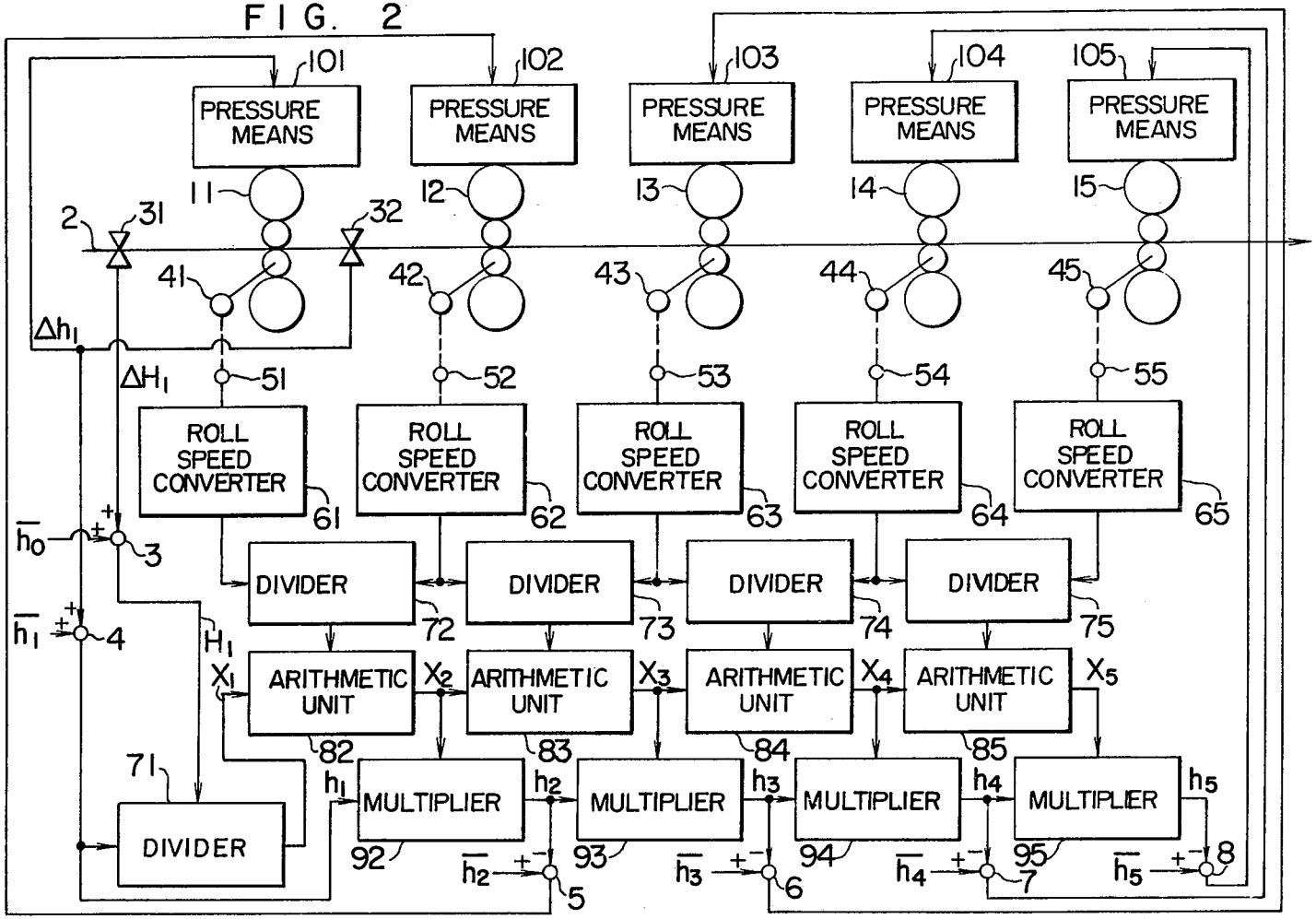
FIG. 2 is a block diagram of a gage control system according to an embodiment of the invention.

Referring to FIG. 2 which shows a hot rolling mill comprising five mill stands arrayed in tandem, the first stand is selected as a particular or specific stand. In the figure, reference numerals 11 to 15 denote individual mill stands, 2 denotes a plate to be rolled. 31 denotes a thickness gage meter disposed at the input side of the first stand, 32 denotes a thickness gage meter provided at the output side of the first stand. The thickness gage meter consists of, for example, an X-ray gage meter detecting a deviation between a reference value and an actual value. Reference numerals 41 to 45 represent electric motors for driving the rolls of the individual mill stands, 51 to 55 designate speed detectors for generating electric signals in proportion to the circumferential speeds of the rolls of the individual stands, and 61 to 65 denote circumferential speed converters for converting the outputs from the speed detectors 51 to 55 into electric signals corresponding to the associated circumferential speeds. Each converters 61 to 65 has a conversion gain of $2\pi$ R. Reference numeral 71 designates a divider for calculating the ratio between the input thickness and the output thickness at the first stand, 72 denotes a divider for calculating the ratio between the circumferential speeds $V_{R1}$ and $V_{R2}$ at the first and the second stands, 73 denotes a divider for calculating the ratio between the circumferential speeds $V_{R2}$ and $V_{R3}$ at the second and the third stands, 74 denotes a divider for calculating the ratio between the circumferential speeds $V_{R3}$ and $V_{R4}$ at the third and the fourth stands, and numeral 75 denotes a divider for calculating the ratio between the circumferential speeds $V_{R4}$ and $V_{R5}$ at the fourth and fifth stands. Reference numerals 82 to 85 denote arithmetic units for calculating the thickness ratio $X_i$ at the second to the fifth stands in compliance with the equation (7). Numerals 92 to 95 designate multipliers for calculating the thickness at the second to the fifth stands in accordance with the equation (8). Numerals 101 to 105 represent pressure means provided for each stand.

In operation, when the leading end of the plate to be rolled reaches the output side of the first stand 11, the thickness gage meter 32 will detect a deviation $\Delta h_1$ of the output thickness $h_1$ from a desired value $h_1$, whereby the pressure means 101 is operated in the direction to cancel out the deviation $\Delta h_1$. At this time, the outputs from the thickness gage meters 31 and 32 are fed to adders 3 and 4 to which signals representative of a reference input thickness $h_0$ and the desired output thickness $h_1$ are applied, respectively, so that actual input and output thicknesses $H_1$ and $h_1$ are obtained from the adders 3 and 4. It should be noticed that X-ray gage meters employed for the thickness gage meters as is common in the art detect a relative thickness to a reference thickness, i.e. a deviation between an actual thickness and a reference or desired thickness. Accordingly, in order to obtain the actual input and output thicknesses $H_1$ and $h_1$, the reference or desired values $H_1$ and $h_1$ have to be added to the detected deviation $\Delta H_1$ and $\Delta h_1$, respectively. The outputs of the adders 3 and 4 are fed to the divider 71 which calculates the thickness ratio $X_1$ $(= h_1/H_1)$ to be applied to the arithmetic unit 82. At this time, however, arithmetic unit 82 is not operated to calculate the thickness ratio $X_2$ at the second stand, which starts its operation when the leading end of the plate 2 is nipped between the rolls at the second stand 12. It is possible to detect variation in load due to the engagement of the plate between the rolls of the second stand by means of a load detecting cell provided at the second stand, thereby to determine the time with the leading end of the plate 2 comes into engagement between the rolls. As an alternative way, the time of engagement may be determined by integrating the circumferential speed of the roll. The speed detectors 51 and 52 detect the rotational speeds of the rolls of the first and second stands 11 and 12. The outputs from these detectors 51 and 52 are applied to the associated roll speed converters 61 and 62 which operate to multiply the inputs by $2\pi$R thereby to convert the inputs into the circumferential speeds, which in turn are applied to the divider 72. The latter will then operate to calculate the ratio between the circumferential speeds of the rolls of the first and the second stands and produce an output which is applied to the arithmetic unit 82. In the arithmetic unit 82, when the plate 2 reaches the second roll 12, the arithmetic operation is performed on the input thickness ratio $X_1$ and the circumferential speed ratio $V_{R1}/V_{R2}$ in accordance with the equation (7), whereby an output representative of the ratio $X_2$is produced. The output $X_2$ is then applied to the multiplier 92 and the arithmetic unit 83 of the third stand. The multiplier 92 generates a product of the input thickness $h_1$ of the second stand and the thickness ratio $X_2$, the result of which represents the output thickness $h_2$ of the second stand. The output from the multiplier 92 is fed to the adder 5 and the multiplier 93. At the adder 5, a deviation of the thickness $h_2$ from the desired value $h_2$ is calculated and fed back to the pressure means 102 of the second stand 12 which will then adjust the screw-down position so as to cancel the deviation. In a similar manner, when the plate 2 reaches the $i$-th stand the thickness ratio $X_i$ at the $i$-th stand is calculated from the circumferential speed ratio $V_{Ri-1}/V_{Ri}$ obtained from the roll speeds of the adjacent ($i$-1)th and $i$-th stands and the thickness ratio $X_1 = h_1/H_1$ at the first stand in accordance with the expression (7). From the values of $X_i$, the output thicknesses of the individual stands are calculated to detect the deviations of the output thicknesses from the respective desired thicknesses. The detected deviations are fed back to the associated pressure means for adjusting the screw-down positions or the roll gaps so that the deviations will disappear.

Figure 3:
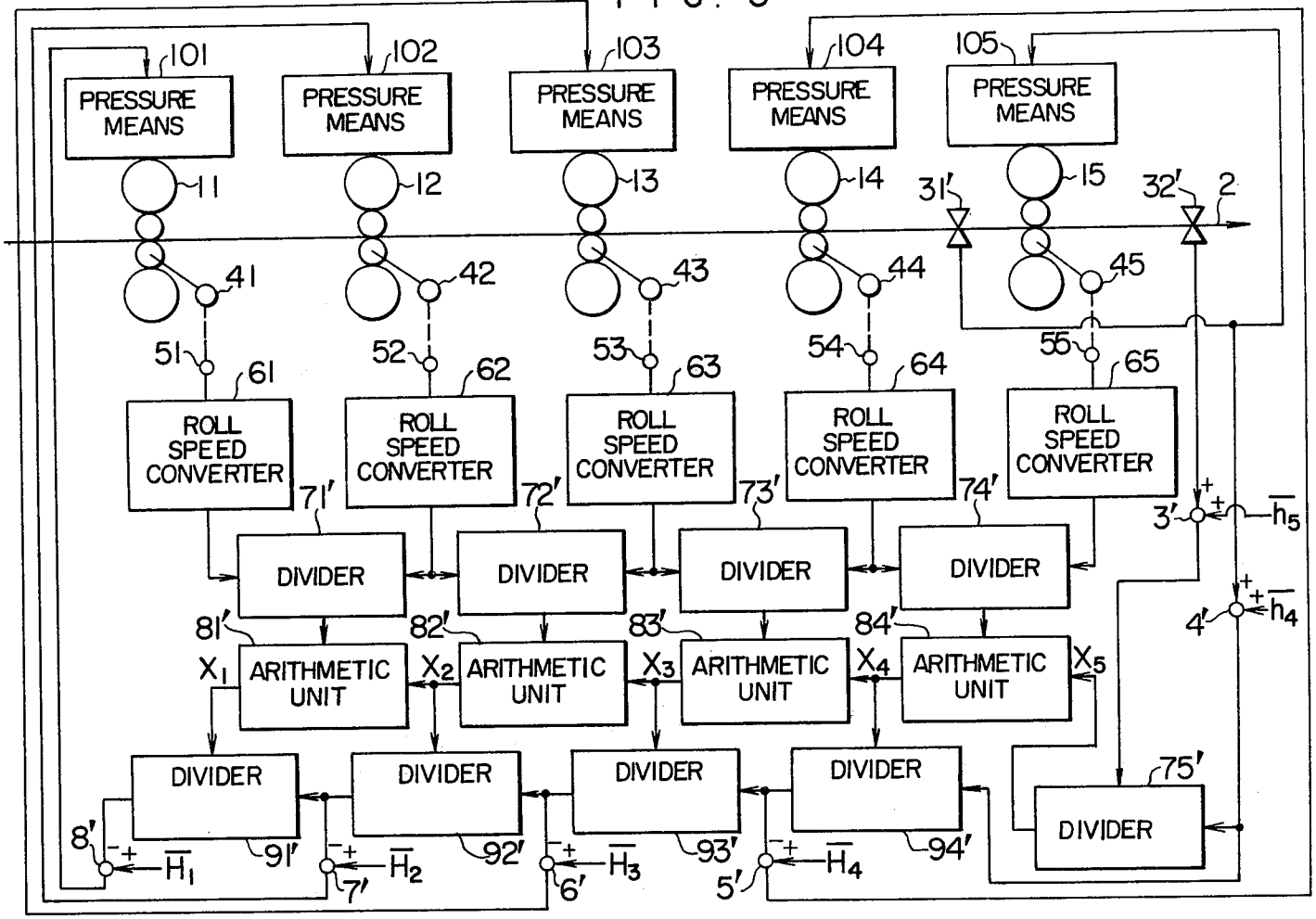
FIG. 3 is a block diagram of another embodiment of the invention.

FIG. 3 shows another embodiment of the invention which is based on the principle expressed by the equation (6). In the figure, the same reference numerals as those of FIG. 2 designate the same constituent elements. Dividers 71′ to 74′ correspond to those designated by 72 to 75 in FIG. 2. However, these dividers are different from the dividers 72 to 75 in that the circumferential speed ratio $V_{Ri+1}/V_{Ri}$ is calculated for the use of the equation (6). Divider 75′ corresponds to the divider 71 shown in FIG. 2 but is adapted to calculate the ratio between the output thickness $h_5$ and the input thickness $H_5$ at the fifth stand. Arithmetic units 81′ to 84′ correspond to those designated by 82 to 85 in the embodiment shown in FIG. 2. However, the operations of these arithmetic units 81′ to 84′ are different from the latter in that the operations are effected in accordance with the equation (5). In more concrete, the arithmetic unit 84′ is adapted to calculate $X_4$ from the output $X_5$ of the divider 75′ and the output $V_{R5}/V_{R4}$ of the divider 74′ in accordance with the equation (5). The arithmetic unit 83′ is adapted to calculate $X_3$ from $X_4$ calculated by the unit 84′ and the output $V_{R4}/V_{R3}$ of the divider 73′ in a similar manner. Dividers 91′ to 94′ are adapted to receive the thickness ratios $X_1$ to $X_4$ of the first to the fourth stands as calculated by the arithmetic units 81′ to 84′ and to produce the input thickness $H_1$ to $H_4$ of the associated stands in accordance with the equation (8). Reference numerals 3′ and 4′ denote adders which operate to convert outputs from thickness gage meters 31′ and 32′ into signals representative of the actual thicknesses $h_5$ and $H_5$ ($= h_4$), as in the case of the adders 3 and 4 of the first embodiment shown in FIG. 2. The adders 5′ to 8′ serve to determine the differences between the actual values of the thicknesses at the input sides of the individual stands obtained by the dividers 91′ to 94′ and the desired values thereof. The difference signals from the adders 5′ to 8′ are applied to the associated pressure means 101 to 104 for adjustment of the screw-down positions or the roll gaps of the associated mill stands so that the differences may be cancelled.

In the above description, tension of the plate 2 to be rolled is out of consideration. When there happens a variation in the tension, the equation (2) is not always true. It will be appreciated that the control for maintaining the tension constant is effected in the gage control systems shown in FIGS. 2 and 3 by means of an appropriate apparatus not shown to improve the accuracy of the control operation. In the case of the hot rolling, the control to maintain the tension constant is usually effected through a mechanical looper. However, in the gage control system according to the invention, there is employed a tension control system in which no looper is used, since space is required for mounting the thickness gage meter at the output side of the particular stand, e.g. at the region between the first and the second stands. As an example of such tension control system, it is possible to estimate the tension by detecting the torques of the electric motors and the rolling loads at the first and the second stands and in accordance with the following formula:

$$\left(\frac{R_1}{P_1}+\frac{R_2}{P_2}\right)T = a\left\{\left(\frac{G_1}{P_1}\right)_o-\left(\frac{G_2}{P_2}\right)_o\right\}-\left(\frac{G_1}{P_1}-\frac{G_2}{P_2}\right) \quad (10)$$

wherein $R_1$ designates radius of the roll at the first stand,
$R_2$ radius of the roll at the second stand,
$P_1$ rolling load at the first stand,
$P_2$ rolling load at the second stand,
T tension between the first and the second stand,
$G_1$ load torque of electric motor of the first stand,
$G_2$ load torque of electric motor of the second stand, and
Suffix "o" shows values under no tension.

Then, the control for maintaining the tension constant can be effected by correcting the roll speed at the first stand in proportion to the estimated tension.

In the case of the embodiment shown in FIG. 2, the thickness gage meter 32 is installed for detecting the thickness at the output side of the first stand. However, the output thickness may be calculated as described below.

From the fact that the volume (mass) of the plate to be rolled remains constant at both the input and the output sides of the first stand, the following equation is obtained.

$$h_oV_o = h_1V_{R1}(1 + a - a(h_1/h_o)) \quad (11)$$

where $h_o(= H_1)$ designates thickness at the input side,
$V_o$ feeding speed of the plate at the input side,
$V_{R1}$ circumferential speed of roll, and
$h_1$ thickness at the output side.

The above equation (11) may be rewritten into the following form:

$$h_1 = \frac{h_o}{2}\left\{1+\frac{1}{a}-\sqrt{\left(1+\frac{1}{a}\right)^2-\frac{4}{a}\,\frac{V_o}{V_{R1}}}\right\} \quad (12)$$

Figure 4:
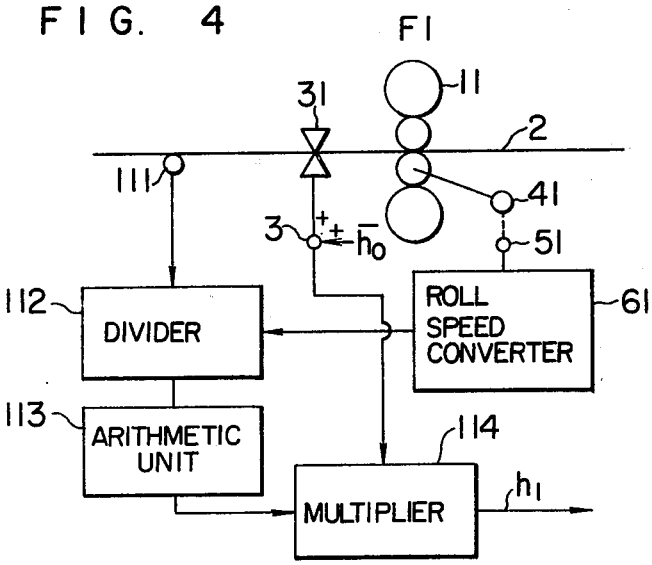
FIG. 4 is a block diagram showing still another embodiment of the invention.

A circuit arrangement for calculating the output thickness $h_1$ in accordance with the equation (12) is shown in FIG. 4, in which reference numeral 111 denotes a speed meter for detecting the speed $V_o$ of the plate to be rolled at the input side of the first mill stand 11, 112 denotes a divider for calculating the term $V_o/V_{R1}$ in the equation (12), 113 denotes an arithmetic unit for calculating $$\frac{1}{2}\left[1+\frac{1}{a}-\sqrt{\left(1+\frac{1}{a}\right)^2-\frac{4}{a}\,\frac{V_o}{V_{R1}}}\right]$$

in the equation (12), and 114 denotes a multiplier. In operation, the feeding speed $V_o$ is detected by the speed meter 111 and applied to the divider 112 together with the circumferential speed $V_{R1}$ of the roll which is detected by the speed detector 51 and the converter 61 in a similar manner as in the embodiment shown in FIG. 2. The output from the divider 112 is applied to the arithmetic unit 113, and the output of arithmetic unit 113 is fed to the multiplier 114. On the other hand, the input thickness $h_o$ is detected through the thickness gage meter 31 and the adder 3 and applied to the multiplier 114. The output from the multiplier 114 represents the output thickness obtained in accordance with the equation (12). The arithmetically obtained value can be utilized in place of the output of the thickness gage meter 32 in FIG. 2 destined to detect the thickness at the output side of the first stand.

In the above embodiments, the description has been made on the assumption that the invention is applied to the hot rolling. However, it is self-explanatory that the invention can be equally applied to various type of rolling mills, since the principle of the invention resides in controlling the thickness of the plate at the individual stands through the arithmetical operation in accordance with the equation derived from the low of constancy of mass flow in consideration of the forward slip ratio which is found to be a variable as shown in FIG. 1.

In the embodiments shown in FIGS. 2 and 4, a set value of thickness of the plate to be rolled may be utilized for the thickness at the input side of the first stand in place of the detected thickness, because the input thickness is relevant only to the forward slip ratio and need not to be detected with a high accuracy.

Figure 5:
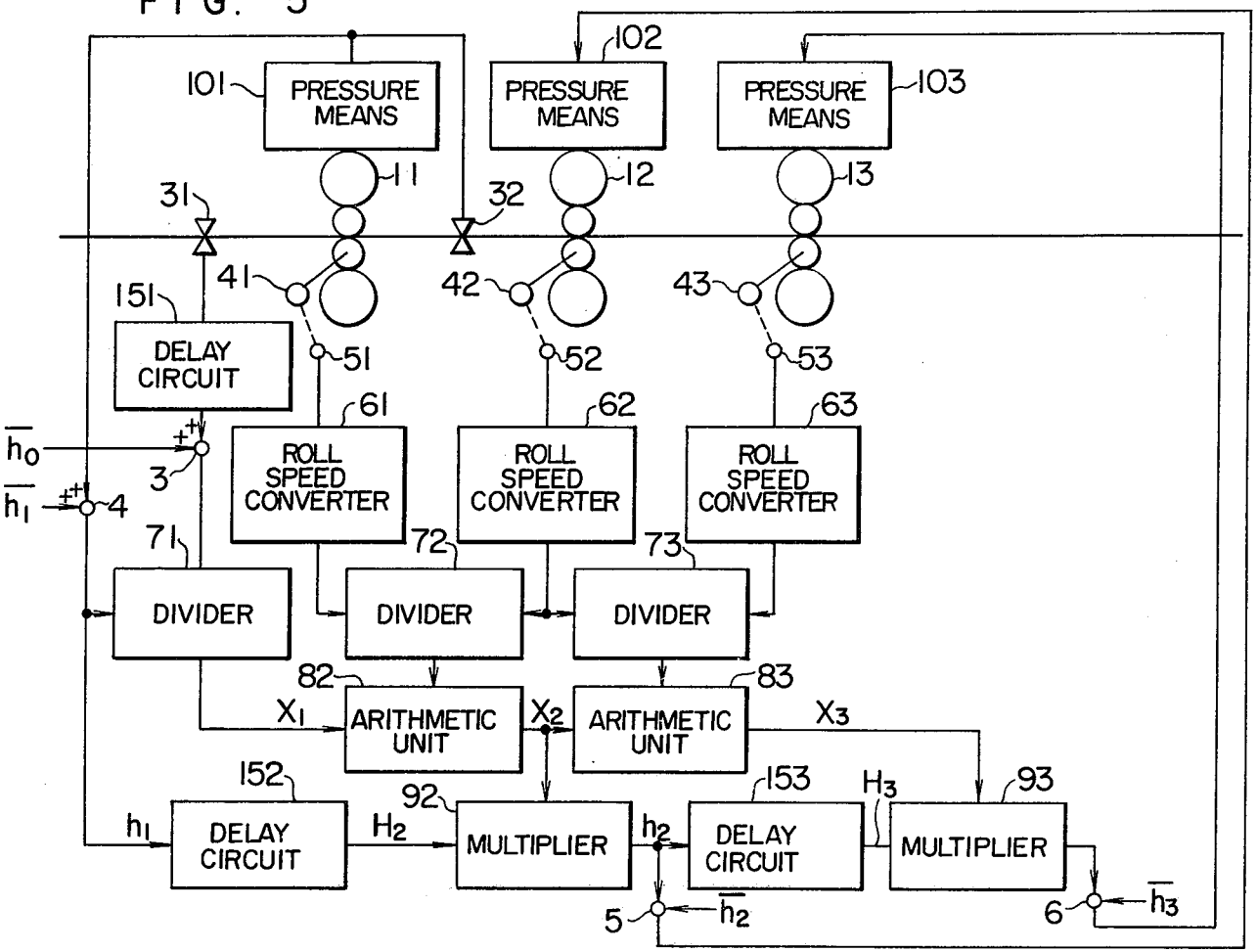
FIG. 5 is a block diagram showing yet another embodiment of the invention.

FIG. 5 shows a modification of the embodiment shown in FIG. 2, in which only three mill stands and the control system associated with the three stands are depicted. In this embodiment, the signal representative of the thickness of the plate 2 at the output side of the $i$-th stand is delayed by a period of time required for the plate 2 to move from the output of the $i$-th stand to the input of the succeeding $(i+1)$th stand, for controlling the screw-down position or the roll gap of the $(i+1)$th stand so that the control accuracy is improved. In FIG. 5, the same reference numerals as those in FIG. 2 denote the same constituent elements. The arrangement shown in FIG. 5 is different from that shown in FIG. 2 only in that delay circuits 151 to 153 are additionally provided, and the other arrangements and operations are the same as those of FIG. 2.

The period of time $t$ required for the plate 2 to move from the output of the $i$-th stand to the input of the $(i+1)$th stand is represented as follows.

$$t = L/V_{Ri} \qquad (13)$$

where $V_{Ri}$ designates circumferential speed of the roll of the $i$-th stand, and L designates distance between the $i$-th stand and the $(i+1)$th 1)th stand. It should be noted that, in the case where the particular stand, i.e. the first stand in the embodiment of FIG. 2, is involved, the L in the equation (13) is measured as a distance between a gage meter (which is the gage meter 32 in the embodiment of FIG. 2) for detecting the output thickness at the particular stand and the succeeding stand.

The delay circuit 153 functions to delay the signal representative of the output thickness $h_2$ at the second stand 12 by the period of time required for the plate 2 to move from the output of the second stand 12 to the input of the third stand 13, and the delay circuit 152 functions to delay the signal representative of the output thickness $h_1$ at the first stand 11 by the period of time required for the plate 2 to move from the gage meter 32 to the input of the second stand 12. The delay circuit 151 is provided in association with the particular stand 11 and functions to delay delivery of the signal representative of the input thickness $h_o$ at the particular stand by the period of time required for the plate 2 to move from the gage meter 31 to the input of the particular stand 11.

Figure 6:
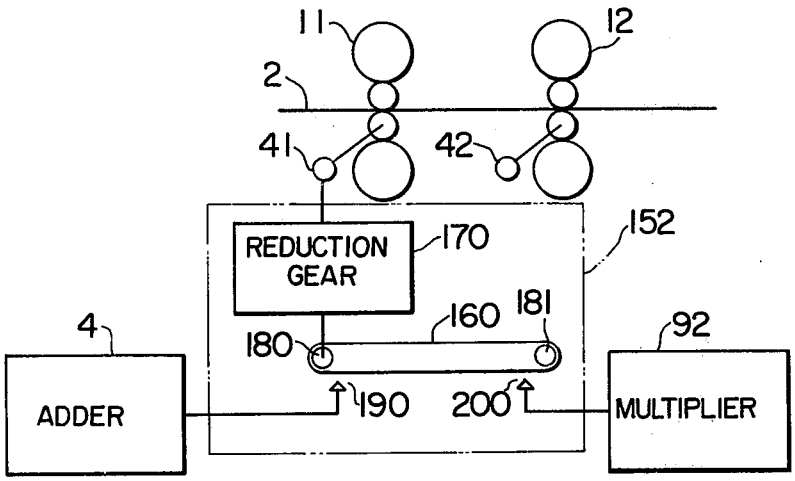
FIG. 6 shows a portion of the arrangement of FIG. 5 in detail.

Each of the delay circuits 151, 152 and 153 is constructed, for example, as shown in FIG. 6. In FIG. 6, the same reference numerals as those in FIG. 2 or 5 denote the same constituent elements, and only the delay circuit 152 is depicted as an example. The delay circuit 152 operates to deliver to the multiplier 92 the signal representative of the output thickness $h_1$ obtained from the adder 4 on the basis of detection by the gage meter 32 at the time when a point on the plate 2 subjected to the detection by the gage meter 32 reaches the second stand 12. The delay circuit 152 comprises a reduction gear 170 directly coupled with the electric motor 41 for driving the rolls of the first stand 11, a pulley 180 directly coupled with and driven by the reduction gear 170, an endless magnetic tape 160 suspended around the pulley 180 and a pulley 181, a writing head 190 and a reading head 200. When the signal representative of the output thickness $h_1$ is applied to the delay circuit 152 from the adder 4 on the basis of the detection by the gage meter 32, the thickness signal is recorded on the magnetic tape 160 through the writing head 190. The magnetic tape 160 is moved at a speed proportional to the feeding speed of the plate 2. Accordingly, the recorded signal is read out through the reading head 200 after a certain period of time elapses and fed to the multiplier 92. By appropriately adjusting the distance between the pulleys 180 and 181, it is possible to deliver the signal representative of the output thickness $h_1$ to the multiplier 92 with a time lag corresponding to the period of time required for the point on the plate 2 subjected to the detection to move from the gage meter 32 to the second stand 12. It will easily be understood that the distance between the pulleys 180 and 181 in the delay circuit 153 is to be adjusted so that the signal representative of the output thickness $h_2$ at the second stand 12 is delivered to the multiplier 93 with a time lag corresponding to the period of time required for a point on the plate 2, which stays at the second stand 12 at the time when the calculations of the arithmetic unit 82 and the multiplier 92 are effected, reaches the third stand 103.

We claim:

1. A gage control method for a tandem rolling mill including a plurality of individual mill stands one of which is determined as a particular stand, comprising steps of:

obtaining a thickness ratio between thicknesses of a plate to be rolled at the input and output sides of said particular stand by obtaining the thicknesses by detecting deviations of the thicknesses from desired thicknesses at the input and output sides of said particular stand, obtaining a circumferential speed ratio between circumferential speeds of rolls of adjacent said mill stands by detecting the circumferential speeds of the rolls, calculating a thickness of the plate at the output or input side of each of said stands other than said particular stand on the basis of said thickness ratio and said circumferential speed ratios, obtaining a deviation of said calculated thickness from a desired thickness at the output or input side of each of said stands other than said particular stand, and adjusting a screw-down position of each of said stands in dependence on said deviation.

2. A gage control method according to claim 1, wherein a control is made to maintain tension of the plate between adjacent said stands constant.

3. A gage control method according to claim 1, wherein the first stand as viewed in the feeding direction of the plate to be rolled is selected as said particular stand, said circumferential speed ratio is obtained as a ratio of the circumferential speed of a roll of one of said stands to that of a roll of succeeding one of said stands, a thickness of the plate at the output side of each of said stands other than said particular stand is calculated, and the screw-down position of each of said stands is adjusted so that the deviation of the thickness of the plate at the output side of said each stand from the desired thickness at said output side is cancelled.

4. A gage control method according to claim 3, wherein said calculation of the thickness of the plate at the output side of each of said stands after obtaining the thickness ratio at said particular stand with a time lag corresponding to a period of time required for a point on the plate subjected to said detection at the output side of said particular stant to reach said each of said stands.

5. A gage control system according to claim 3, wherein tension of the plate between the first and second stands is determined from a ratio between torque of an electric motor for driving said first stand and rolling load at said first stand as well as a ratio between torque of an electric motor for driving said second stand and rolling load at said second stand, thereby to correct the roll speed of said first stand in proportional dependence on said tension.

6. A gage control method according to claim 3, wherein the thickness of the plate at the output side of said first stand is estimated from the thickness at the input side of said first stand by utilizing fact that mass flows of said plate at both sides of said first stand are equal to each other.

7. A gage control method according to claim 3, wherein a set thickness of the plate are utilized as said thickness at the input side of said first stand in place of the thickness obtained through said detection.

8. A gage control method according to claim 1, wherein the last stand as viewed in the feeding direction of the plate to be rolled is selected as said particular stand, said circumferential speed ratio is obtained as a ratio of the circumferential speed of a roll of one of said stands to that of a roll of preceding one of said stands, a thickness of the plate at the input side of each of said stands other than said particular stand is calculated, and the screw-down position of each of said stands is adjusted so that the deviation of the thickness of the plate at the input side of said each stand from the desired thickness at said output side is cancelled.

9. A gage control method for a tandem rolling mill including a plurality of individual mill stands one of which is determined as a particular stand, comprising steps of:

detecting thicknesses of a plate to be rolled at the input and output sides of said particular stand to obtain a reduction ratio, obtaining a forward slip ratio as a function of said reduction ratio, calculating a thickness of the plate at the output or input side of each of said stands other than said particular stand in accordance with the low of constancy of mass flow incorporating the forward slip ratio obtained as a function of the reduction radio, obtaining a deviation of said calculated thickness from a desired thickness at the output or input side of each of said stands, and adjusting a screw-down position of each of said stands in dependence on said deviation.

10. A gage control method according to claim 9, wherein said function of the reduction ratio is a linear function.

11. A gage control apparatus for a tandem rolling mill including a plurality of individual mill stands one of which is determined as a particular stand, comprising:

means for detecting a deviation of a thickness of a plate to be rolled at least at the input or output side of said particular stand from desired thicknesses at said input and output sides, means for obtaining the thicknesses of the plate at the input and output sides of said particular stand on the basis of said detection, means for obtaining a thickness ratio between said thicknesses of the plate, means for detecting a circumferential speed of a roll of each of said stands, means for obtaining a circumferential speed ratio between the circumferential speeds of the rolls of adjacent said stands, means for calculating a thickness of the plate at the output or input side of said stands other than said particular stand on the basis of said thickness ratio and said circumferential speed ratios, means for obtaining a deviation of said calculated thickness from a desired thickness at the output or input side of each of said stands other than said particular stand, and means provided in association with respective said stands for adjusting a screw-down position of each of said stands in dependence on said deviation.

12. A gage control apparatus according to claim 11, in which the first stand as viewed in the feeding direction of the plate to be rolled is selected as said particular stand, wherein said circumferential speed ratio obtaining means comprises a divider for dividing the circumferential speed of a roll of one of said stands by the circumferential speed of a roll of succeeding one of said stands, and said thickness calculating means comprises pairs of arithmetic units and multipliers provided in association with respective said stands other than said particular stand, each pair of said arithmetic unit and multiplier calculating a thickness of the plate at the output side of the associated one of said stands, whereby said screw-down position adjusting means adjust the screw-down position of the associated one of said stands so as to cancel the deviation of the thickness of the plate at the output side of the associated stand from the desired thickness at said output side.

13. A gage control apparatus according to claim 12, wherein said apparatus further comprises a delay circuit for delaying a signal representative of the thickness of the plate at the output side of the particular stand to be applied to said thickness calculating means associated with a stand subsequent to said particular stand by a period of time required for the plate to move from a point at which said detection at the output side of the particular stand is effected to said subsequent stand, and other delay circuits each for delaying a signal representative of the thickness of the plate at the output side of a corresponding one of said stands produced from said thickness calculating means associated with said corresponding one stand and to be applied to said thickness calculating means associated with a stand subsequent to said corresponding one stand by a period of time required for the plate to move from said corresponding one stand to said subsequent stand.

14. A gage control apparatus according to claim 12, wherein said thickness obtaining means comprises means for detecting a speed of the plate at the input side of the particular stand, means receiving an output of said plate speed detecting means and an output of said circumferential speed obtaining means for obtaining a ratio between said two speeds, and means for calculating the thickness of the plate at the output side of the particular stand on the basis of said speed ratio and the thickness of the plate at the input side of the particular stand obtained from said detection at said input side.

15. A gate control apparatus according to claim 11, in which the last stand as viewed in the feeding direction of the plate to be rolled is selected as said particular stand, wherein said circumferential speed ratio obtaining means comprises a divider for dividing the circumferential speed of a roll of one of said stands by the circumferential speed of a roll of preceding one of said stands, and said thickness calculating means comprises pairs of arithmetic units and multipliers provided in association with respective said stands other than said particular stand, each pair of said arithmetic unit and multiplier calculating a thickness of the plate at the input side of the associated one of said stands, whereby said screw-down position adjusting means adjust the screw-down position of the associated one of said stands so as to cancel the deviation of the thickness at the input side of the associated stand from the desired thickness at said input side.

* * * * *